US007617781B2

(12) United States Patent
Batdorf

(10) Patent No.: US 7,617,781 B2
(45) Date of Patent: Nov. 17, 2009

(54) OXYGEN ENHANCED PLASMA WASTE TREATMENT SYSTEM AND METHOD

(75) Inventor: James A. Batdorf, Kennewick, WA (US)

(73) Assignee: Integrated Environmental Technology LLC, Richland, WA (US)

( * ) Notice: Subject to any disclaimer, the term of this patent is extended or adjusted under 35 U.S.C. 154(b) by 0 days.

(21) Appl. No.: 10/962,906

(22) Filed: Oct. 12, 2004

(65) Prior Publication Data

US 2006/0075945 A1 Apr. 13, 2006

(51) Int. Cl.
*F33G 5/10* (2006.01)
*F23G 5/10* (2006.01)

(52) U.S. Cl. ..... 110/250; 110/346

(58) Field of Classification Search ..... 110/250, 110/238, 346; 219/121.11, 121.36, 121.59
See application file for complete search history.

(56) References Cited

U.S. PATENT DOCUMENTS 4,586,443 A * 5/1986 Burge et al. ..... 110/347
4,611,332 A * 9/1986 Santen ..... 373/24
4,886,001 A * 12/1989 Chang et al. ..... 110/346
5,980,782 A * 11/1999 Hershkowitz et al. ..... 252/373
6,037,560 A * 3/2000 Titus et al. ..... 219/121.37

* cited by examiner

*Primary Examiner*—Kenneth B Rinehart
(74) *Attorney, Agent, or Firm*—Douglas E. McKinley

(57) ABSTRACT

A method and apparatus that improves the efficiency of waste processing in waste treatment systems utilizing a high temperature plasma as the a energy source by delivering pressurized oxygen to the waste products while the waste products are exposed to the high temperature plasma. Providing oxygen at a speed of at least fifty feet per second obtains more energy content in the syngas, less solid carbon particulate, and faster gasification rates, improving process economics.

6 Claims, 1 Drawing Sheet

OXYGEN ENHANCED PLASMA WASTE TREATMENT SYSTEM AND METHOD

CROSS-REFERENCE TO RELATED APPLICATIONS

Not Applicable

BACKGROUND OF THE INVENTION

The need to safely and economically dispose of industrial and household wastes in an environmentally acceptable manner has inspired a designers to propose a variety of waste processing systems utilizing high temperatures generated by plasma sources. One advantage of such plasma systems is their ability to turn inorganic portions of a waste into a glass, or vitrified, form which exhibits long term stability when the vitrified material is deposited in a landfill. Examples of such systems are found in U.S. Pat. No. 6,018,471, filed Mar. 16, 1998, U.S. Pat. No. 5,847,353, filed Aug. 7, 1996, U.S. Pat. Nos. 5,811,752 and 5,756,957, both filed Mar. 25, 1996, U.S. Pat. No. 5,798,497, filed Jun. 19, 1995, and U.S. Pat. No. 5,666,891, filed Feb. 2, 1995, all of which are incorporated herein by this reference.

Typically, within these high temperature systems, the energy value of organic materials is recovered by gasifying the materials, to converting them into useful energy sources. Gasification of organic materials consists of a complex combination of reactions including thermal decomposition; full and partial oxidation with steam, carbon dioxide, and oxygen; and the water gas shift reaction ($CO+H2O=CO2+H2$). Thermal decomposition (also referred to as pyrolysis) results in the formation of very fine solid carbon particles. This material, although not favored by equilibrium thermodynamics, is slow to react and often remains un-reacted until it is removed by the offgas cleaning equipment. This material impacts the process economics in two ways—first it's heating value is lost from the product fuel gas and second removal of this carbon particulate increase offgas cleaning costs. For these reasons, designers of high temperature waste treatment systems have long sought methods and techniques that may by used to eliminate or reduce carbon particulate, sometimes referred to as "carbon carryover." Examples of such methods and techniques include U.S. Pat. No. 6,576,210, filed Aug. 22, 2001, which describes a method for destroying carbon carryover created in high temperature plasma waste treatment systems by first capturing carbon carryover in a slurry, and then directing the slurry back into the high temperature plasma waste treatment system to convert the carbon into a synthesis gas. The entire contents of this patent, and all other patents, papers, or other publications referenced in the remainder of this disclosure are hereby incorporated in their entirety by this reference. Despite the advantages taught in U.S. Pat. No. 6,576,210, the further reduction or elimination of carbon particulate is still a universal goal among designers of high temperature waste treatment systems, as any reduction in carbon particulate improves overall process economics.

BRIEF SUMMARY OF THE INVENTION

Accordingly, it is an object of the present invention to provide a method and apparatus that improves the efficiency of waste processing in waste treatment systems utilizing a high temperature plasma as the a energy source. Typically, these systems have a chamber having an inlet for receiving a waste product, an outlet for removing vitrified wastes, an outlet for removing metals, an outlet for removing gasified wastes, and a means for exposing waste products introduced into the chamber to the high temperature plasma. The inventors of the present invention have discovered that within such an arrangement, economically significant reductions in the amount of carbon particulate matter produced during waste processing may be achieved by delivering pressurized oxygen to the waste products while the waste products are exposed to the high temperature plasma. Provided the oxygen is delivered at sufficient speed, the inventors have discovered that the net effect of using this high velocity oxygen injection is to obtain more energy content in the syngas, less solid carbon particulate, and faster gasification rates. While all of these benefits improve overall process economics, the later benefit is the most significant impact on the process economics.

While not meant to be limiting, the present invention can be advantageously operated in systems utilizing an electrical arc created by an electrode, a plasma torch, and combinations thereof. The means for directing pressurized oxygen to the waste products while the waste products are exposed to the high temperature plasma is preferably selected as an oxygen lance, a nozzle, or a combinations thereof. The term "pressurized oxygen" should be understood to include gases containing oxygen, including, without limitation, air and oxygen enriched air, in addition to oxygen gas, and this disclosure should be understood to contemplate any oxygen containing gas as an acceptable substitute within the various descriptions of "pressurized oxygen" or "oxygen injection" described herein. Regardless of the specific form selected, the inventors have discovered that oxygen injection at a velocity of 50 feet per second or greater produces the most advantages processing conditions.

DETAILED DESCRIPTION OF THE INVENTION

Figure 1:
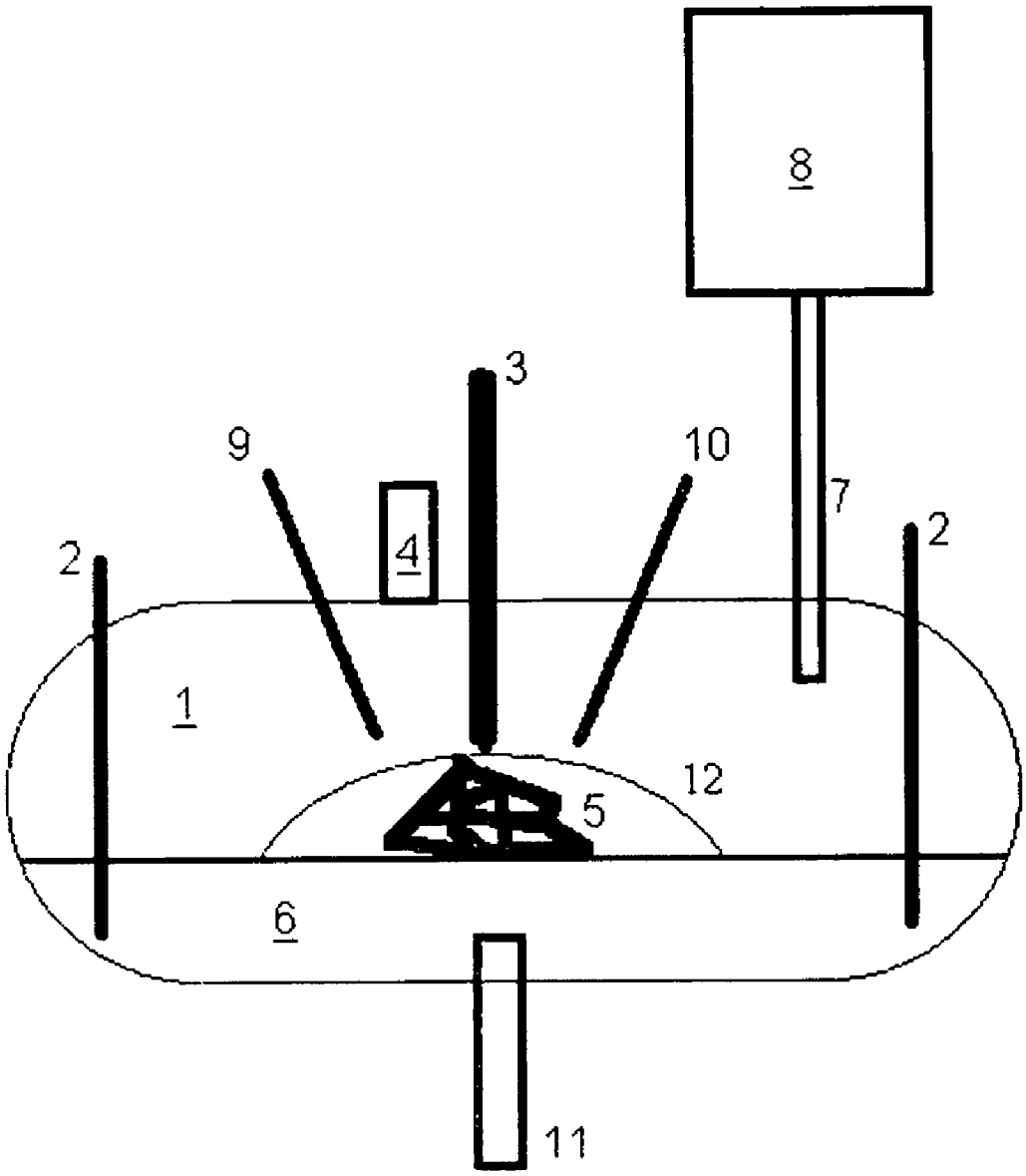
FIG. 1 is a schematic drawing of one possible configuration of the present invention showing the injection of oxygen into the chamber with an oxygen lance.

A series of experiments were conducted to demonstrate the ability of the present invention to enhance the operation of a waste processing system. The specific system used in these experiments combines joule heating with plasma heating in a configuration described generally in U.S. Pat. No. 6,630,113, the entire contents of which are hereby incorporated by this reference. This system is manufactured by Integrated Environmental Technologies, LLC, (IET) of Richland Wash., and is known as a "Plasma Enhanced Melter™", or PEM™ system. The system also included a "Thermal Residence Chamber" or TRC unit. Essentially, the TRC holds gas exiting the main processing chamber at an elevated temperature for a period of time sufficient to allow the completion of gas-phase reactions. The general arrangement of the PEM™ system used for these experiments is shown in FIG. 1. As shown in the figure, the PEM™ system includes a processing chamber 1 (shown in a cutaway view) having two or more joule 2 and one or more plasma 3 electrodes, an inlet 4 for waste 5, a glass bath 6, an outlet 7 for gaseous products produced in the processing chamber and leading to the TRC 8, an inlet for steam 9, an inlet for oxygen 10, and a drain for glass an/or metal 11.

The inlet for oxygen 10 may be selected as a lance, a nozzle, or combinations thereof. A plasma 12 is generated by one or more plasma 3 electrodes. As shown in FIG. 1, oxygen from inlet for oxygen 10 may be directed into waste 5 and plasma 12.

Medical waste, packaged in small cardboard tubes, was processed in a PEM™ system at the IET Technical Center sized to process up to ½-ton of waste per day. The system generally consists of a liquid-cooled, solid steel chamber, lined with refractory materials. A glass bath is maintained within this refractory by maintaining an electrical path through at least one set of electrodes (joule heating electrodes). Wastes introduced into the system are placed on this glass bath in the plenum space where they are then exposed to plasma from a graphite electrode. The plasma converts the organic and low boiling point portions of the waste to a gaseous state, and the inorganic and high boiling point portions of the waste are incorporated into the glass. In these experiments, the PEM™ system was operated with steam injection through a low-velocity lance that injects the steam into the plenum space of the PEM™ chamber. The flow of steam was pointed at the feed pile, to promote the participation of steam in gas phase reactions within the plenum space.

Oxygen was injected using two different methods. In the first method, oxygen was injected at very high velocities (approaching and/or exceeding the speed of sound) through a water-cooled lance with a small orifice. In the second method, oxygen was injected concurrently with the steam at low velocities. The steam/oxygen mixture was directed at the feed pile in the center of the chamber. The test objective was to observe the effect of the high velocity oxygen injection on the processing rate.

Adding oxygen to a gasification process resulted in several actions, all of which benefit processing efficiency. Although oxygen will react with any organic compound, its reaction rate will be highest with mobile gas phase compounds—hydrogen, methane, ethane, carbon monoxide, etc. At the point of reaction, the energy released raises the local temperature. On a larger scale, adding oxygen will increase the overall energy released in the system and this will increase the bulk average temperature. Adding oxygen, by raising the local temperature and reacting directly with the organic compounds, increases the local rate of gasification. By increasing the local temperature, the rate of reaction of carbon particulate to gas phase compounds increases. Also, adding oxygen in the vicinity of the solid organic compounds may influence the gasification process and prevent the formation of solid phase carbon particulate.

Gasification assisted by oxygen injected under low velocities was observed to result in the oxygen reacting in the plenum (gas phase) portion of the reaction chamber. This increases the bulk average temperature, which may have a slight affect on the average gasification rate. Unfortunately, this oxygen will react to a large extent with gas phase hydrogen and carbon monoxide—the two main products. Oxygen injected in this manner is unlikely to have a significant effect on the formation of carbon particulate.

Gasification assisted by oxygen injected under high velocities resulted in a large fraction of the oxygen reacting near or at the solid organic compound surface. This resulted in more oxygen reacting with the solid organic compounds, as evidenced by increased production of hydrogen and carbon monoxide, and decreased formation of solid carbon particulate. By increasing the local temperatures, water vapor in the vicinity of the solid organic compounds reacted at a higher rate with these compounds and any carbon particulate formed by gasification reactions.

Medical waste for the testing was shredded and steam sterilized. The shredded and sterilized waste contained a high concentration of plastic and rubber. The rubber consisted of both latex and nitrile surgical/examination gloves. The waste also contained drapes, surgical tubing, small pieces of hard plastic, and other un-identifiable items. Since the waste was collected from the outlet of the steam sterilization process, the as received waste was very wet.

The waste was air dried to evaporate excess moisture. The density after drying was approximately 11 lb/ft$^3$ (84 lbs per 55-gallon drum). The waste was hand packed into small cardboard mailing tubes with plastic end caps. The cardboard tubes had the following properties:

Tube inner dimensions: 2 inches ID×6 inches inside length

Tube overall length: 7 inches.

Tube wall thickness: 0.060 inches.

Empty cardboard tube weight: 41.5 grams

Weight of 2 plastic end caps: 8.5 grams

Average gross weight of tube with medical waste and end caps 135 grams

The desired processing rate was 8.5 lbs/hr. Using an average container weight of 135 grams and a container feed rate of 30 containers per hour (I container every 120 seconds) results in a feed rate of 8.9 lbs per hour. The mass and energy balance was used to estimate appropriate values for the oxygen and steam flow rates. The remaining parameters were determined from past operating experience.

TABLE 1

Operating Parameters for ½-ton Medical Waste Test

| Parameter | Setting | Notes |
|---|---|---|
| Oxygen to PEM ™ | 1.1 scfm | Oxygen required for a CO to (CO + CO2) ratio of 0.7. |
| Oxygen to TRC | 0.25 scfm | Oxygen required for maintaining the TRC temperature. |
| Steam to PEM ™ | 3.0 lb/hr | Steam required for gasification. |
| PEM ™ target temperature | 1000° C. | Operate PEM as hot as possible with a target of 1200° C. |
| TRC outlet target temperature | 850-900° C. | The model indicates that a 900° C. outlet temperature implies that the internal temperatures exceed 1200° C. for at least 2 seconds. |
| Quench flow—nitrogen | 70 cfh @ 10 psig | Minimize nitrogen |
| Quench flow—water | 0 | Only use if needed. |
| Baghouse | N/A | Pulse as needed |
| Chilled water supply | 51° F. (11° C.) | As cold as practical. |
| Offgas blower | 60 Hz | Set at constant value during processing. |
| Offgas blower outlet temperature. | 40 to 50° C. | Temperature expected based on operating experience. |
| Preheat carbon beds. | 50° C. | Preheat carbon beds prior to start of test to prevent condensation. |
| Carbon bed operation | Heaters off, insulated. | Minimize heat loss during testing, but remove possibility of hot spots. |
| Genset operation | Load bank on full. Emergency vent open. | Process all synthesis gas through the genset. |

Test Operations

Preheat

Operating the DC arc at 10 kW for 4-hours preheated the PEM™ chamber in the ½-ton test system to a temperature of 975° C. Firing a propane burner in the Thermal Residence Chamber (TRC) for 4 hours preheated the TRC to a temperature of 910° C. The propane burner was removed from the TRC. Medical waste was fed to the system at a rate of 8.9 lbs per hour.

Processing

The test was conducted as shown in Table 2. Processing conditions were maintained as stable as possible and operation was switched back and forth between the High Velocity lance and the Low Velocity lance. When switching, it was difficult to maintain the exact same oxygen flow because of differences in the pressure drop between the two methods. Also, as the test progressed, the high velocity lance changed dimension (either from heat effects or glass deposits), which resulted in differences in flow and pressure. These effects, although minor, were sufficient to change the total flow oxygen and add to the uncertainty introduced by the limited accuracy of the oxygen flow meter.

TABLE 2

Process Conditions during Test Operations

| Time | Oxygen Injection | Steam Flow (lb/hr) | PEM ™ $O_2$ | TRC $O_2$ |
|---|---|---|---|---|
| 10:15 | High Velocity | 0.0 | 75 scfh @ 3 psig | 50 scfh @ 7.5 psig |
| 11:15 | High Velocity | 3.0 | 50 scfh @ 3 psig | 25 scfh @ 0 psig |
| 12:35 | Low Velocity | 3.0 | 50 scfh @ 3 psig | 25 scfh @ 0 psig |
| 13:04 | High Velocity | 3.0 | 50 scfh @ 3 psig | 25 scfh @ 0 psig |
| 13:34 | Low Velocity | 3.0 | 60 scfh @ 0 psig | 25 scfh @ 4 psig |
| 14:12 | High Velocity | 3.0 | 55 scfh @ 4 psig | 25 scfh @ 4 psig |

Results

A simple mass balance was used to analyze the results. First, 3 periods of stable operation were identified for both the High Velocity and Low Velocity operating conditions. Second, the offgas composition (CO, $CO_2$, $H_2$, and $CH_4$) was averaged for each of these time periods. Third the mass balance model was used to calculate the solid carbon particulate formation, the effective process temperature, and the closure of the oxygen balance.

Mass Balance Model

The mass balance model used the following measurements as the basis for the model:

1. Total nitrogen purge flow rate.
2. Medical waste feed rate.
3. Average medical waste and cardboard tube composition.
4. Steam flow rate.
5. Oxygen flow rate to the PEM™.
6. Oxygen flow rate to the TRC.

This information was combined to estimate the feed rate of nitrogen, oxygen, hydrogen, and carbon. The nitrogen content of the offgas was determined by adding the concentrations of the measured gases and assuming that the balance was nitrogen. The nitrogen flow rate was then combined with this value to determine the offgas flow rate. This flow rate allowed calculation of the carbon leaving the system. The solid carbon generated was calculated to be the difference between the carbon input and the carbon output. The water-gas shift equilibrium was used along with a hydrogen mass balance to calculate the effective temperature. The closure of the oxygen balance was the calculated to determine the quality of the model. Table 3 shows the results of these calculations.

TABLE 3

Results of Data Analysis Using Mass Balance

| Oxygen Lance | Carbon Produced | Effective Temperature (° C.) | Oxygen Velocity (ft/sec) | Oxygen Balance Closure (%) |
|---|---|---|---|---|
| High Velocity | 9% | 1217 | 290 | 12% |
| High Velocity | 9% | 1188 | 290 | 16% |
| High Velocity | 10% | 1170 | 320 | 17% |
| Low Velocity | 13% | 1187 | 40 | 13% |
| Low Velocity | 11% | 1199 | 50 | 14% |
| Low Velocity | 11% | 1193 | 50 | 13% |

CONCLUSIONS average carbon production decreased from 12% to 9% when switching from the low velocity lance to the high velocity lance. This is a substantial improvement, but may not represent the best effect that can be achieved with this concept. The Low Velocities values are lower than expected and low when compared with historical data for this system (20 to 30% would be more typical). This is probably an indication of the improved functionality of the TRC chamber, which was modified in March 2004 (just prior to this test sequence) and is now being operated at higher temperatures—which may allow more of the carbon produced to back react.

CLOSURE

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

The invention claimed is:

1. A waste treatment system comprising:

a. a chamber having an inlet for receiving a non-gaseous waste product, an outlet for removing vitrified wastes, an outlet for removing gasified wastes, and an electrical arc created by an electrode for exposing non-gaseous waste products introduced into said chamber to a high temperature plasma; and b. a means for directing pressurized oxygen at a rate of at least 50 feet per second to said non-gaseous waste products while said non-gaseous waste products are exposed to said high temperature plasma.

2. The waste treatment system of claim 1 wherein said pressurized oxygen is provided in a form selected from the group air, oxygen enriched air, and oxygen.

3. The waste treatment system of claim 1 wherein said means for directing pressurized oxygen to said non-gaseous waste products while said non-gaseous waste products are exposed to said high temperature plasma is selected from the group consisting of an oxygen lance, a nozzle, and combinations thereof.

4. A method of improving the efficiency of a waste treatment system having a chamber having an inlet for receiving a non-gaseous waste product, an outlet for removing vitrified wastes, an outlet for removing gasified wastes, and a means for exposing non-gaseous waste products introduced into said chamber to a high temperature plasma; comprising a. providing a means for directing pressurized oxygen at a rate of at least 50 feet per second to said non-gaseous waste products while said non-gaseous waste products are exposed to said high temperature plasma.

5. The method of claim 4 wherein said pressurized oxygen is provided in a form selected from the group air, oxygen enriched air, and oxygen.

6. The method of claim 4 wherein said means for directing pressurized oxygen to said non-gaseous waste products while said non-gaseous waste products are exposed to said high temperature plasma is selected from the group consisting of an oxygen lance, a nozzle, and combinations thereof.

* * * * *